United States Patent [19]

Marinoff et al.

[11] 4,437,546

[45] Mar. 20, 1984

[54] FIRE ESCAPE DEVICE

[75] Inventors: Gerald P. Marinoff, 8 Rockford Dr., West Nyack, N.Y. 10994; W. Dorwin Teague, Nyack, N.Y.

[73] Assignee: Gerald P. Marinoff, West Nyack, N.Y.

[21] Appl. No.: 314,882

[22] Filed: Oct. 26, 1981

[51] Int. Cl.[3] ..... A62B 1/12

[52] U.S. Cl. ..... 182/233; 182/238; 182/5

[58] Field of Search ..... 182/233, 238, 5, 231, 182/236, 71, 6, 7, 237, 239, 240; 188/65.1; 254/377; 242/99, 107.3

[56] References Cited

U.S. PATENT DOCUMENTS

| | | | |
|---|---|---|---|
| 439,191 | 10/1890 | Roper . | |
| 516,117 | 3/1894 | Roper . | |
| 537,383 | 4/1895 | Buckelew . | |
| 624,432 | 5/1899 | Buddenbohn | 182/237 |
| 1,122,566 | 12/1914 | Bailey . | |
| 1,145,923 | 7/1915 | Rolston . | |
| 1,167,239 | 1/1916 | Winkler | 182/238 |
| 1,631,279 | 6/1927 | Mandy . | |
| 1,734,833 | 11/1929 | Shearen . | |
| 1,761,311 | 6/1930 | Redmond | 182/233 |
| 2,091,418 | 8/1937 | Schoene . | |
| 2,703,219 | 3/1955 | Henshaw . | |
| 2,933,324 | 4/1960 | Stimler | 182/3 |
| 3,241,642 | 3/1966 | King . | |
| 3,289,968 | 12/1966 | Wilson | 242/99 |
| 3,760,901 | 9/1973 | Hynes | 182/7 |
| 3,847,377 | 11/1974 | Byrd . | |
| 3,860,092 | 1/1975 | Holmes | 182/73 |
| 3,861,496 | 1/1975 | Hoover | 182/5 |
| 3,871,501 | 3/1975 | Kornylak . | |
| 3,907,256 | 9/1975 | Kankkunen | 182/238 |
| 3,946,989 | 3/1976 | Tsuda | 182/5 |
| 4,018,423 | 4/1977 | Belew | 182/238 |
| 4,088,201 | 5/1978 | MacFarlane | 182/5 |
| 4,324,387 | 4/1982 | Steinhagen | 254/377 |
| 4,372,422 | 2/1983 | Sharp | 182/5 |

FOREIGN PATENT DOCUMENTS

| | | | |
|---|---|---|---|
| 2306110 | 2/1973 | Fed. Rep. of Germany | 182/238 |
| 1498226 | 1/1978 | United Kingdom | 182/5 |

*Primary Examiner*—R. P. Machado
*Assistant Examiner*—Alvin C. Chin-Shue
*Attorney, Agent, or Firm*—Arthur Dresner

[57] ABSTRACT

A fire escape device includes a housing with a reel journalled for rotational movement within the housing. A cable is fixed at one end thereof to the reel and is wound upon the reel with the other end thereof extending through an opening in the housing. The housing can be connected to a fixed position on an elevated structure and a harness which is carried at the free end of the cable is used for supporting a human body. A fluid pump is carried by the housing for pumping fluid from a sump reservoir through an orifice. The rotor of the pump is coupled with the reel for retarding and impeding free rotational movement of the reel so that the cable unwinds at a controlled rate of speed which is in direct proportion to the amount of fluid being pumped through the orifice.

9 Claims, 5 Drawing Figures

FIRE ESCAPE DEVICE

FIELD OF THE INVENTION

The present invention relates generally to the field of fire escapes, and more particularly, to a fire escape device which can be portable or permanently affixed to a structure and which can be used to lower human beings of various weights from elevated positions at controlled rates of descent.

Specifically, the invention is of the type which includes a housing having a spool or drum carrying a prewound cable which has a free end available for attachment to a harness to be secured about the body of a human being.

BACKGROUND OF THE INVENTION

Fire escape devices of the type relating to the present invention are well known in the patent art. Similar devices are known in which a cable is wound on a drum or reel. A variety of mechanisms have been suggested as means to retard the rotational movement of the drum so as to control the rate of cable unwinding and thus determine the speed of descent of an individual suspended from the cable.

One of the typical techniques used to control the rate of descent of the person being lowered by the device includes the use of fluid, or hydraulic friction producing systems. However, most of these prior art devices have suffered from a variety of disadvantages. These include complex piston and cylinder arrangements to pneumatically control the rotational movement of the reel or drum. Such devices require operating fluids of a particular viscosity in order to perform properly and have therefore been found to be impractical particularly for use from excessive heights because of requirements for reservoir capacities. Additionally, prior art devices appear to suffer from a common disadvantage relating to the ability to control at a relatively constant rate of descent the speed at which human beings of vastly different weights can be lowered from elevated positions. Also, many of the prior art devices are either not reusable or cannot be made portable.

Although the patent literature contains many examples of structures and devices for portable fire escapes, none appear to have become acceptable for wide spread use. Yet, the continued occurences of tragic fires in hi-rise structures, accompanied by the needless loss of life, highlights the need for an effective and usable fire escape device which can be made portable and therefor used both by permanent residents and travellers in hi-rise apartment buildings, office buildings, or hotels as a safe and reliable means of being lowered from a burning structure.

OBJECTS OF THE INVENTION

It is accordingly a principal object of the present invention to provide a fire escape device which overcomes the disadvantages of the prior art by providing a mechanism which may be portable, is easy to use and reliable so that it may become acceptable for use as a means for saving lives.

A more specific object of the present invention is to provide a fire escape device of the type which incorporates a cable wound upon a rotatable drum, the unwinding rotating speed of which is controlled by the use of a fluid caused to pass through an orifice by a pump mechanism coupled to the rotating drum, which orifice is of a size determined to control the rate of rotation of the drum independent of fluid viscosity.

Yet another object of the present invention is to provide a fire escape device of the type described which is compact and of a size which is acceptable for portable use.

A still further object of the invention is to provide a fire escape device which carries adjustable means to permit placement of the device on the exterior of a burning structure away from the source of heat and for securing the device to any point within a romm of the structure.

Other objects, features and advantages of the present invention will become more apparent from the description of the invention in connection with the accompanying drawings.

SUMMARY OF THE INVENTION

The foregoing objects, features and advantages of the present invention are generally accomplished by providing a fire escape device which includes a housing with a reel journalled for rotational movement within the housing. A cable is fixed at one end thereof to the reel and is wound upon the reel with the other end thereof extending through an opening in the housing. The housing can be connected to a fixed position on an elevated structure and a harness which is carried at the free end of the cable is used for supporting a human body. A fluid pump is carried by the housing for pumping fluid from a sump reservoir through an orifice. The rotor of the pump is coupled with the reel so that the cable unwinds at a controlled rate of speed which is in direct proportion to the amount of fluid being pumped through the orifice. A mechanism is also provided to rewind the cable onto the reel after it has been withdrawn. An adjustable tether is also provided to permit the securing of the device to the structure and placement for use on the exterior of the structure.

BRIEF DESCRIPTION OF THE DRAWINGS

The foregoing features of the present invention will become apparent from the following detailed description of the invention in connection with the drawings in which.

DETAILED DESCRIPTION OF THE INVENTION

Figure 1:
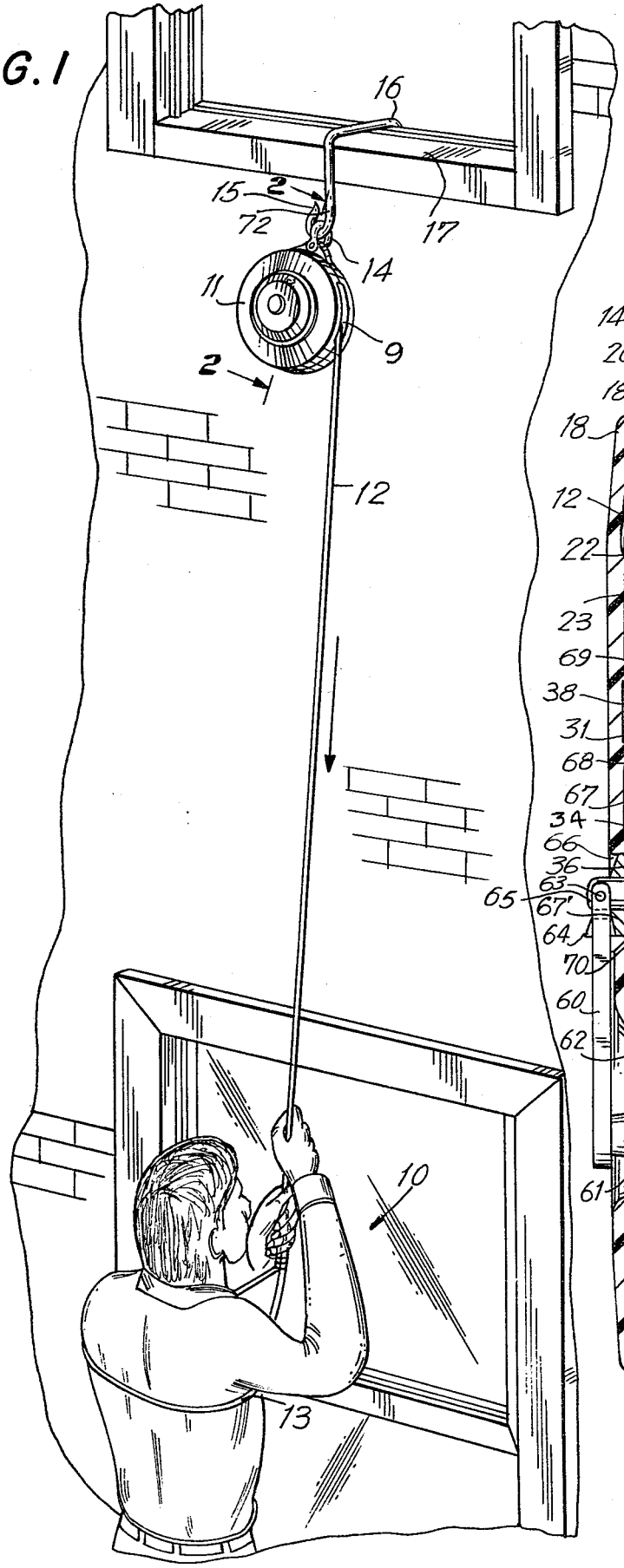
FIG. 1 is an elevational pictorial representation illustrating the fire escape device of the present invention in actual use.
Figure 2:
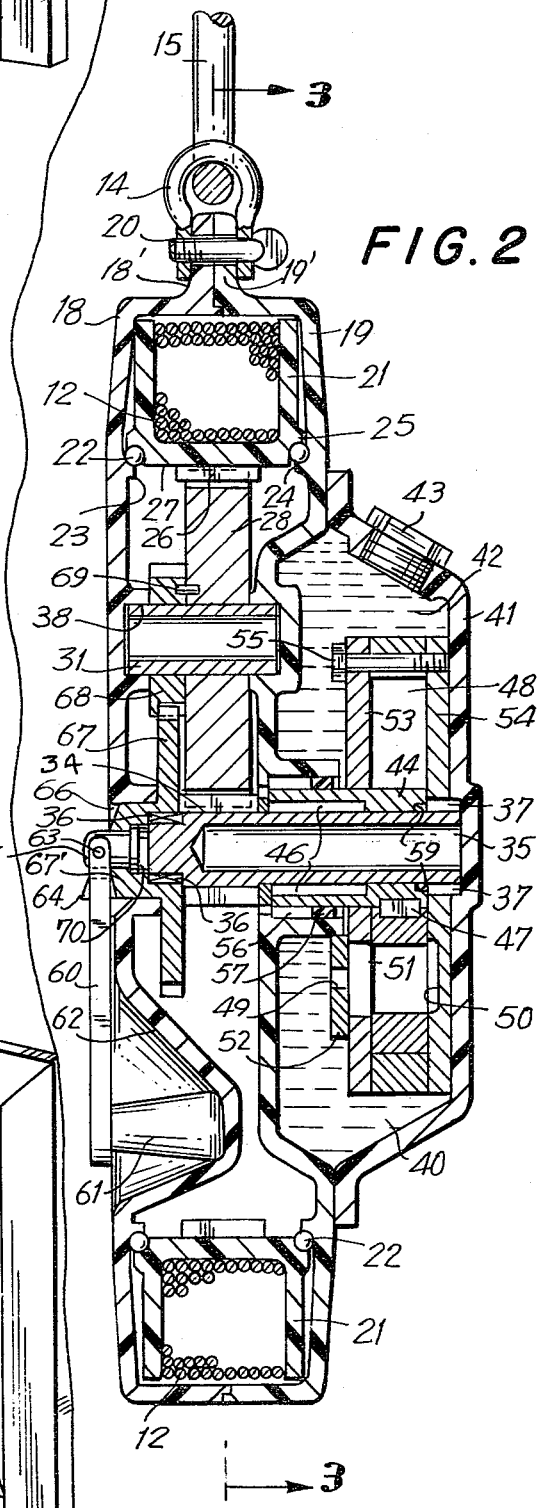
FIG. 2 is a sectional view taken along lines 2—2 of the device illustrated in FIG. 1.
Figure 3:
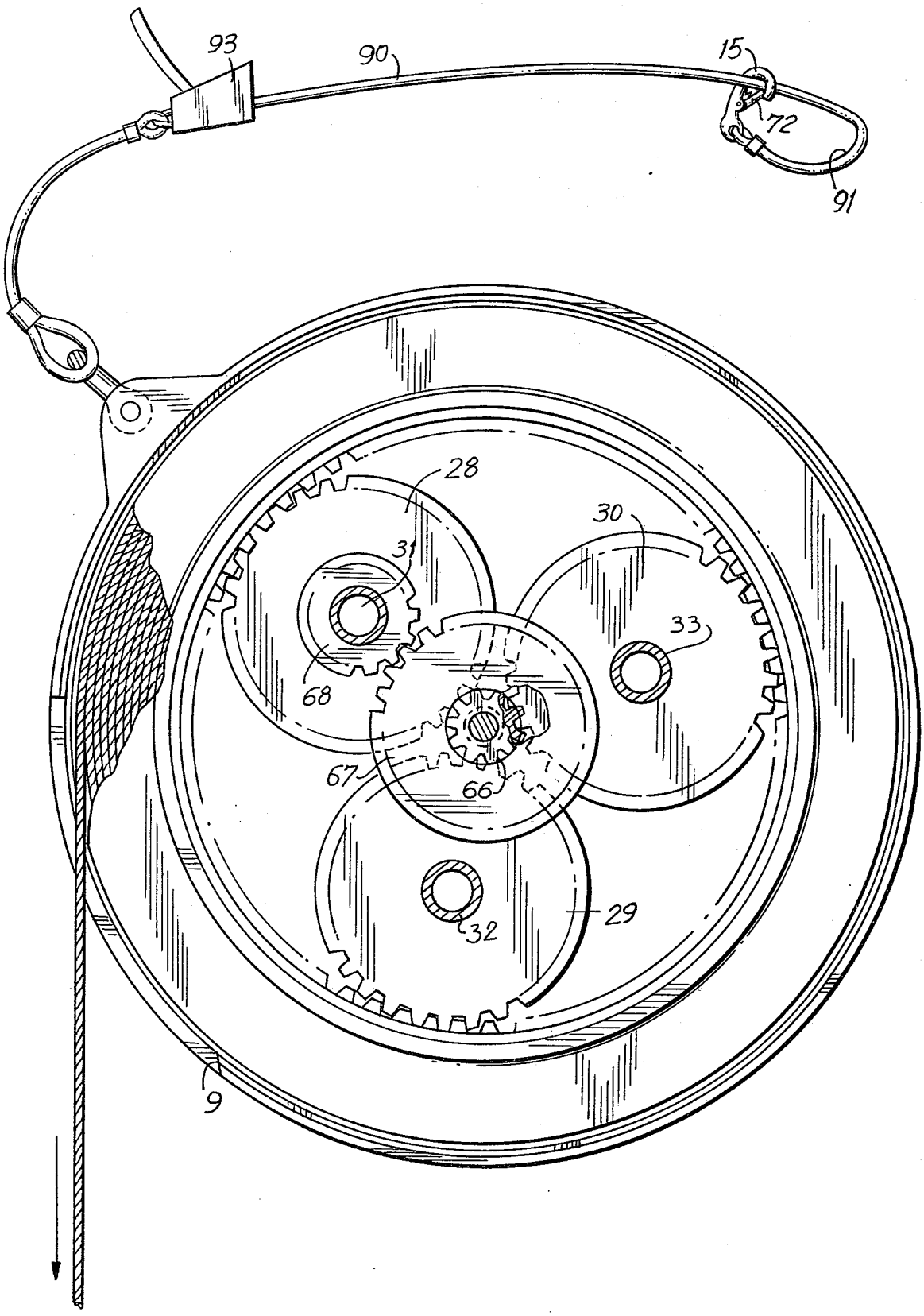
FIG. 3 is a plan view taken in the direction of arrows 3—3 of FIG. 2.
Figure 4:
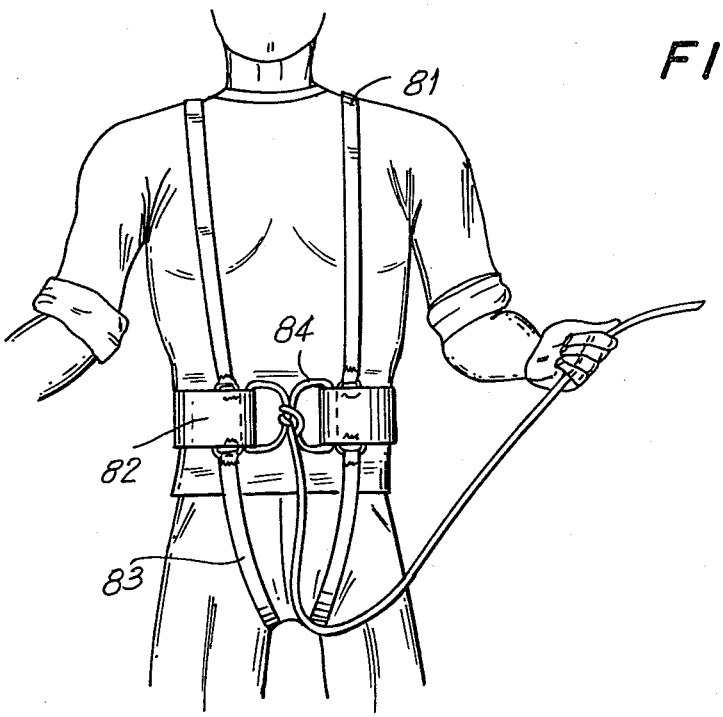
FIG. 4 is a perspective view of a preferred harness for use in conjunction with the present invention.

Referring now in more detail to the accompanying drawings, FIG. 1 illustrates a human being 10 being lowered from an elevated structure by the use of the present invention indicated generally by reference numeral 11. A cable 12 is carried within the device 11 and can be unwound therefrom through an opening 9 in the housing of the device 11. The human being may be secured to the end of the cable 12 by means of harness 13. FIG. 4 illustrates a preferred commercially available type of harness. This harness is of the type provided with both leg and arm straps to prevent tilting or tipping while descending. An arrangement of straps is provided to form arm strappings 81, waistband 82 and leg straps 83. A buckle 84 is also provided to secure the waistband around the user. Alternatively, a chair type harness with a seat arrangement can be provided.

A shackle 14 is bolted to the housing of the device 11 to provide means for securing the device to the structure. While a number of devices may be used for this purpose, one example of securing the device 11 to the structure is illustrated in FIG. 1 and includes a hook 15 with a safety latch 72 passing through the shackle 14. The hook 15 may be attached by a variety of supporting structures such as the U-shaped support 16 which is shown as being positioned over a windowsill 17.

Figure 5:
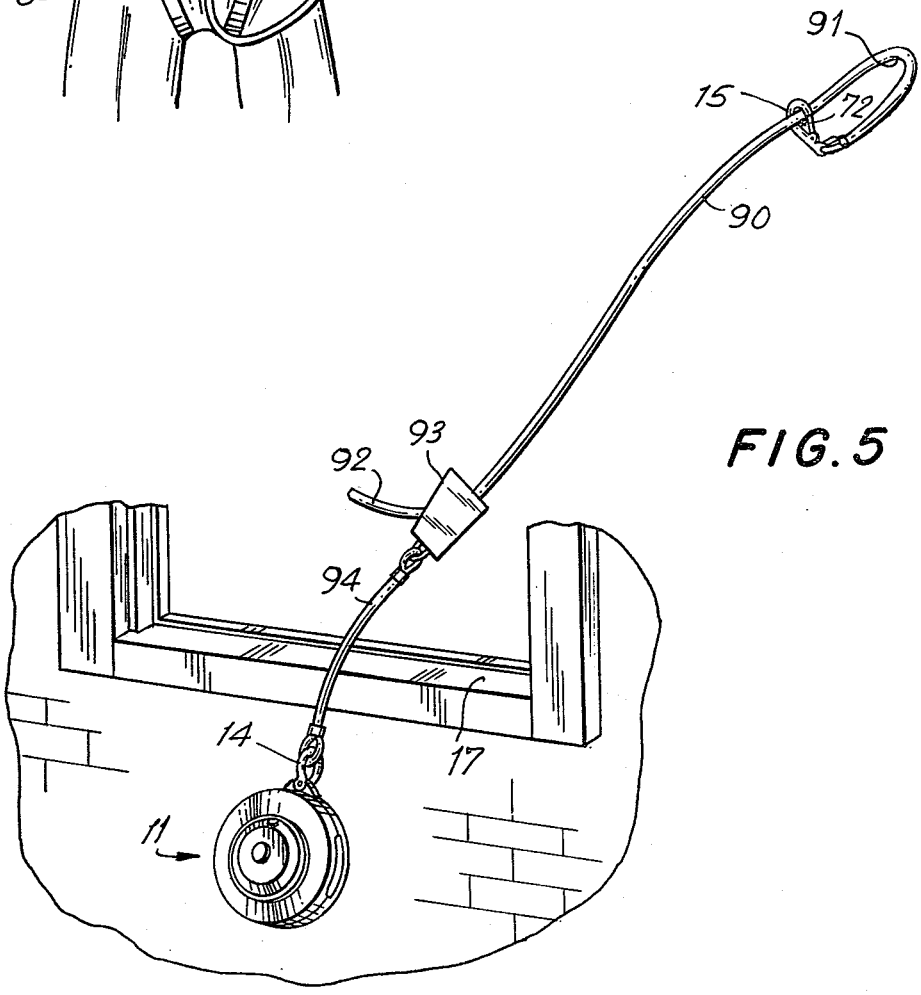
FIG. 5 is a pictorial representation illustrating the adjustable tether for attachment of the device to a structure.

A more desirable means of securing the device 11 to the structure and which serves to render the device portable comprises a tether 90, as illustrated in FIG. 5. The tether 90 is preferably made of stainless steel and may be as much as 20 feet long. A hook, similar to hook 15, carrying a safety latch 72, is provided at one end of the tether so that a loop 91 may be formed at that end of the tether for use in securing the tether to any permanent fixture, such as a pipe, bedpost, or other permanent fixture within a room of the structure. The other end 92 of the tether is caused to pass through an adjusting mechanism 93 so that the length of the tether extending from the adjusting mechanism 93 to the end 91 may be varied. The adjusting mechanism 93 may be similar to an "ascender" such as are commercially available from suppliers of mountain climbing equipment for use in shortening the supporting cable lengths. The adjusting mechanism 93 is attached via a stainless steel cable 94 to shackle 14 of the device 11 so that the device may be placed on the exterior of the structure such as through and over a windowsill 17.

The use of the tether and the adjusting mechanism 93 renders the device portable so that it can be used in most situations. The stainless steel cable 94 permits placement of the device 11 over edges of a structure, such as the windowsill 17, without fear of abrasion and breakage.

Alternatively, the device may be permanently affixed to the wall of the structure either on the interior or exterior of the structure by such means as bolts passing through the housing of the device.

The device 11 includes a cylindrical housing formed by a first cover 18 and a second cover 19. It has been found desirable that the housing cover 18 and 19 be formed of an engineering plastic, preferably glass reinforced, such as the commercially available plastic known by the trademark RYNITE*. The housing covers 18 and 19 may be secured along a seam such as by welding or heat sealing after the various structural elements of the device are fully assembled. The shackle 14 is preferably secured to a flange 18' of housing cover 18 and flange 19' of housing cover 19 by means of a bolt 20.

*Trademark of duPont de Nemours Co., Inc.

Within the housing a reel or drum 21, also formed of an engineering glass reinforced plastic material, is mounted for rotation on ¼" ball-bearings made of a material such as DELRIN* 22. The housing covers 18 and 19, as well as the drum 21, have been molded so as to form lips 23, 24 and 25, respectively, to create a socket or bearing race for the ball-bearings 22.

*Trademark of duPont de Nemours Co., Inc.

While a variety of sizes for the various elements of the device have been considered, certain dimensions have been found to be practical and desirable. Reference to such sizes and dimensions hereinbelow, are therefore, believed to be the most preferable. Accordingly, the most preferable size for the outside diameter of the drum 21 has been found to be 9⅝".

A ring gear 26, which is preferably molded integrally with the drum 21 is formed on the inner circumferential surface 27 of the drum 21. Preferably, the ring gear has a 6" diameter with a pitch of 12, and therefore, 72 teeth.

An arrangement of planet gears 28, 29 and 30 are journaled for rotation on fixed bearing shafts 31, 32 and 33 respectively. Housing covers 18 and 19 are molded so as to provide supporting recesses 38 for the fixed bearing shafts 31, 32 and 33. The planet gears are also preferably DELRIN* molded and have a preferred 2" pitch diameter with a gear pitch of 12, and therefore, 24 teeth. A sun gear 34, preferably made of steel and having a 1" pitch diameter with a gear pitch of 12 is formed integrally with a steel shaft 35, which is journalled on needle bearings 36 and 37 commercially available from the Torington Company. Bearings 36 are of one type, while bearings 37 are of a different type to accommodate the increased diameter of the shaft 35.

*Trademark of duPont de Nemours Co., Inc.

A sump structure 40 is formed by the enclosure of a sump housing 41, preferably made of the same material of which the housing covers 18 and 19 are made of. Sump cover 41 may be formed integrally with cover 19 or secured thereto by bolting, heat staking or welding. The sump structure 40 carries a fluid 42. A filler plug 43 may be used for access to the sump 40.

Shaft 35 is coupled via a combination free wheel and bearing 46 to a hollow shaft 44, which is keyed to the rotor of a pump 48 by key 47. Free wheeling bearings 46 permit positive engagement between shaft 35 and hollow shaft 44 in one direction, and free wheeling unrestricted rotational movement in the opposite direction.

Pump 48 is used to drive the sump fluid 42 through a fixed orifice 49. The pump utilized in the present invention may be a gear pump type and is preferably of the Geroter type, which is a positive displacement mechanism using inner and outer tooth elements with one tooth differential. Fluid is drawn into the pump through an inlet port 50 and exits an outlet port 51 through orifice 49 in a cover plate 52 into the sump reservoir formed by the structure 40.

Cover plate 52 is secured to the pump housing front wall 53 by any suitable means. Pump housing rear wall 54 is secured to the sump housing 41. The housing formed by walls 53, 54 may either be secured together by a bolt arrangement 55 and then to the sump housing 41, or may be formed integrally with the sump housing 41.

Bearings 56 and seals 57 and 59 serve to journal the collar 44 for rotation and prevent any leakage of sump fluid from the sump reservoir.

In use and operation of the invention, the user will secure the tether 90 to a fixed position in the structure by wrapping the loop about a point. The length of the tether will then be adjusted depending on the distance from the fixed point to the exterior, such as a window, by pulling the tether through the adjuster 93. The user may then place the device on the exterior to remove it from any source of heat. The user will secure the harness 13 to his body and allow himself to be lowered at a controlled rate of speed by the cable 12, which is being withdrawn through opening 9 of the housing, and which has previously been wound on the drum 21. It has been found that approximately 220 feet of ⅛" cable can be accommodated on the drum which has been described hereinabove.

It will be appreciated that the dimensions of the separate elements of the present invention may be varied, so as to the change the capacity of the drum, the rate of descent, and the linear footage of cable available for use. The size of the orifice and the pump may also be varied to provide a particular user of a particular weight with a custom designed device for a predetermined rate of descent.

As the cable is being withdrawn from the housing, drum 21 will be caused to rotate on bearings 22. In turn, ring gear 26 will cause planet gears 28, 29 and 30 to rotate, which in turn will drive sun gear 34 thus causing shaft 35 to rotate in a first direction. Rotation of shaft 35 in a particular direction will cause positive rotation of hollow shaft 44 thus driving the rotor of pump 48 so that fluid will be drawn through the pump and forced out through orifice 49. The size of orifice 49, being significantly smaller than the outlet port 51 will impede the flow of the fluid 42 through the pump, and thus, serve to retard or otherwise dampen and brake rotation of shaft 35. The dampened rotation of shaft 35 will in turn limit the rate of rotation of ultimately the drum 21 by impeding rotation of intermediary gears 34 and the planetary gear system.

Because of the use of orifice 49 to retard or dampen rotation of shaft 35, a sump fluid having almost any viscosity will be adequate, and in fact, the successful operation of the invention is thereby rendered independent of the viscosity of the fluid. This is unlike devices known in the prior art which required operating fluids having a high viscosity. The present invention on the other hand, merely requires a fluid capable of maintaining a constant viscosity over a wide temperature range, but is otherwise independent of a particular viscosity. This will be appreciated from the fact that the flow rate of a fluid through an orifice is a function of the pressure drop across that orifice. This is well known from the equation: $Q=CA\sqrt{\Delta P}$ where Q=the flow rate, C=orifice constant, A=orifice area and ΔP=the pressure drop across the orifice. It will clearly be appreciated that the pressure drop across the orifice is directly proportional to the weight of the individual at the end of the cable, and the flow rate is proportional to the rate of descent. Therefore, the descent rate is proportional to the square root of the weight of the individual. Accordingly, viscosity of the sump fluid should have some, but little effect on the flow rate through the orifice and therefore the rate of descent.

It has been calculated that the temperature of the sump fluid will rise by a predictable amount when the device is in use due to the work performed on the fluid as a result of being pumped through the orifice which is caused by the descent of the person using the device. Calculations have established that the heat rise is directly proportional to the weight of the user and the distance of descent, and is inversely proportional to the volume of fluid within the sump and is also inversely proportional to the specific heat of the fluid. Because the amount of maximum heat rise can be calculated for situations involving a maximum permissible weight and distance of descent, the required volume of fluid in the sump is also determined so as to be sufficient to prevent excessive temperature rise in the fluid.

Accordingly, by predetermining the size of orifice 49, the amount of retardation of rotation of both shaft 35 and ultimately drum 21 can be accurately controlled. Therefore, a personalized device can be created by choosing an orifice size appropriate for a particular weight of the user.

Since the rate of descent will be proportional to the square root of the users weight, and if it is arbitrarily assumed that the maximum weight of any user will not exceed approximately 300 pounds, and that at that weight it is desired to limit his rate of descent to no more than approximately 12 feet per second (which would be approximately equivalent to such 300 pound person jumping off a platform 2.2 feet high, and therefore, clearly an acceptable maximum rate of descent), the diameter of the fixed orifice can easily be calculated with a particular choice of rated pump speed. With the assumption of a maximum body weight and a desired controlled rate of descent, the various dimensions of the elements can be determined, once the orifice size is calculated. For body weights ranging between 30 and 250 pounds, desired rates of descent will range from approximately 3.5 feet per second to approximately 10.5 feet per second depending upon the design parameters chosen for the pump 48, the orifice 49 and the dimensions of the various gears and gear ratios coupling the pump with the drum 21. Thus, depending upon the desired parameters chosen, drum 21 can be retarded in its unwinding rotational movement to any desired rate.

Upon complete descent, the user will unfasten the harness to allow the next user, stationed with the device, to rewind the cable onto the drum. This is accomplished through the rewind mechanism. The rewind mechanism includes a crank 60 with handle 61 being retained in an unused position in a recess 62 of the cover 18. In order to rewind the cable, crank 60 is caused to pivot 180° about a pivot pin 63 which is carried on shaft 65. Shaft 65 is spaced from shaft 35 by spring washer 70. The end of crank 60 adjacent the pivot pin 63 carries a pawl 64 which will engage one of a plurality of serrations 66 in the hub 67' of a DELRIN driving gear 67. Driving gear 67 engages with a rewind driven gear 68, which is journalled for rotation on the fixed bearing shaft 31. Rewind driven gear 68 is coupled to the planetary gear system through pin 69.

Accordingly, when the crank 60 is pivoted about pin 63 through 180°, pawl 64 will engage with a serration 66 on the hub of rewind driving gear 67. Rotation of crank 60 will thus drive gear 67, so that driven gear 68 will cause the planetary gears to drive the drum 21 in a rewinding direction. The rewinding direction will be opposite to the unwinding direction, and since the free wheeling bearings 46 permit rotation of shaft 35 in a second direction opposite to its first direction without causing rotation of hollow shaft 44, and therefore, without driving pump 48, shaft 35 can freely rotate without retarded movement caused by pump 48 forcing sump fluid through the orifice 49.

An automatic rewind mechanism such as by spring loading reel 21, may also be provided.

Upon completion of rewinding cable 12, the device will be ready for use by the next person.

Although the present invention has been described and illustrated with respect to a certain preferred embodiment which produces satisfactory results, it will be appreciated by those skilled in the art, after understanding the principals of the invention, that various changes and modifications may be made without departing from the spirit and scope of the invention, and it is therefore, intended to cover all such changes and modifications in the appended claims.

What is claimed is:

1. A fire escape device comprising a housing, a reel journalled for rotational movement within said housing, a cable fixed at one end thereof to said reel being wound upon said reel with the other end thereof extending through an opening in said housing, means carried by said housing for connecting said device to a fixed position on an elevated structure, harness means carried at the free end of said cable for supporting a human body, a sump reservoir within said housing, positive displacement fluid pump means carried by said housing for pumping fluid from said sump reservoir through an orifice, said pump means having a rotor, means coupling the rotor of said pump with said reel for retarding and impeding free rotational movement of said reel and at a controlled rate of speed in direct proportion to the amount of fluid being pumped through said orifice, said means coupling the rotor of said pump with said reel comprises a ring gear carried by said reel for rotation therewith, a shaft journalled for rotation within said housing and coupled with the rotor of said pump for driving said rotor when said shaft is rotated in a first direction, and a planetary gear system coupled between said ring gear and said shaft for causing rotation of said shaft in said first direction when said reel is rotated in a direction for unwinding of said cable, free wheeling bearing means journalling said shaft so that when said shaft is rotated in a second direction opposite to said first direction, said rotor will not be driven, and a cover plate mounted over the exit port of said pump, said orifice being formed in said cover plate, and wherein said orifice is dimensioned so as to control the rate of flow of fluid therethrough and thereby the rate or retardation of said reel, whereby the rate of retardation of said reel is independent of the viscosity of said fluid.

2. The first escape device according to claim 1 wherein said ring gear is formed integrally with said reel.

3. The fire escape device according to claim 2 wherein said reel is mounted for rotation within said housing upon a ball bearing race, and wherein said reel is formed of a glass reinforced plastic material.

4. The fire escape device according to claim 3 further comprising means in said housing for access to said sump.

5. A fire escape device comprising a housing, a reel journalled for rotational movement within said housing, a cable fixed at one end thereof to said reel being wound upon said reel with the other end thereof extending through an opening in said housing, means carried by said housing for connecting said device to a fixed position on an elevated structure, harness means carried at the free end of said cable for supporting a human body, a sump reservoir within said housing, fluid pump means carried by said housing for pumping fluid from said sump reservoir through an orifice, said pump means having a rotor, means coupling the rotor of said pump with said reel for retarding and impeding free rotational movement of said reel and at a controlled rate of speed in direct proportion to the amount of fluid being pumped through said orifice, said means coupling the rotor of said pump with said reel comprises a ring gear carried by said reel for rotation therewith, a shaft journalled for rotation within said housing and coupled with the rotor of said pump for driving said rotor when said shaft is rotated in a first direction, and a planetary gear system coupled between said ring gear and said shaft for causing rotation of said shaft in said first direction when said reel is rotated in a direction for unwinding of said cable, a rewind mechanism for winding said cable upon said reel, comprising a crank coupled to a second shaft journalled for rotation within said housing, means carried by said crank for driving a drive gear, means coupled to said drive gear for causing rotation of said reel in a direction opposite to the unwinding direction.

6. The first escape device according to claim 5 wherein said means coupling said gear to said reel comprises a driven gear mounted for rotation within said housing in cooperative engagement with said drive gear, and means carried by said driven gear coupling said driven gear to said planetary gear system.

7. The fire escape device according to claim 6 wherein said means coupled to said planetary gear system for driving said planetary gear system to cause rotation of said reel in a direction opposite to the direction of unwinding said cable is a pin connecting said driven gear to said plenetary gear system, said shaft being driven in said second direction without causing rotation of said rotor upon rotating said crank.

8. The fire escape device according to claim 7 further comprising a recess in said housing, said crank being movable to a position within said recess.

9. The fire escape device comprising:

a housing;

an adjustable length of tether connected at one end thereof to said housing for securing said device to a fixed position;

a rotatably mounted reel carried within said housing;

a predetermined length of cable fixed at one end thereof to said reel and arranged to be wound upon said reel, the other end of said cable extending through an opening in said housing and carrying means at said other end thereof for supporting a human body;

a reservoir formed within said housing for carrying a fluid therein;

a cover plate positioned within said housing having an orifice of a predetermined size therethrough;

a pump carried within said housing for pumping fluid from said reservoir through said orifice;

a planetary gear system mounted within said housing for coupling said reel with said pump for driving said pump when said reel rotates in a first direction for unwinding said cable therefrom;

a rewind mechanism carried by said housing for causing rotation of said reel in a second direction opposite to said first direction for winding said cable upon said reel;

means for permitting rotational movement of said reel in said second direction without driving said pump; and whereby upon rotational movement of said reel in said first direction said pump will cause fluid to pass through said orifice at a controlled flow rate thereby retarding rotational movement of said reel independent of the viscosity of said fluid and proportional to a force exerted on said cable for causing rotational movement of said reel in said first direction.

* * * * *